US005317886A

United States Patent [19]

Prahl

[11] Patent Number: 5,317,886

[45] Date of Patent: Jun. 7, 1994

[54] FLEXIBLE ABRASIVE MEANS

[75] Inventor: Ernst Prahl, Hamburg, Fed. Rep. of Germany

[73] Assignee: Hermes-Schleifmittel GmbH & Company, Hamburg, Fed. Rep. of Germany

[21] Appl. No.: 844,668

[22] PCT Filed: Oct. 9, 1990

[86] PCT No.: PCT/EP90/01689

§ 371 Date: Apr. 9, 1992

§ 102(e) Date: Apr. 9, 1992

[87] PCT Pub. No.: WO91/05896

PCT Pub. Date: May 2, 1991

[30] Foreign Application Priority Data

Oct. 10, 1989 [DE] Fed. Rep. of Germany ... 8912060[U]

[51] Int. Cl.[5] ..... D04B 21/14; C09K 3/14

[52] U.S. Cl. ..... 66/192; 51/295

[58] Field of Search ..... 66/192, 193; 51/295, 51/298

[56] References Cited

U.S. PATENT DOCUMENTS

| | | | |
|---|---|---|---|
| 446,084 | 2/1891 | Stowe | 66/192 |
| 3,675,447 | 7/1972 | Jackson | 66/192 |
| 3,728,876 | 4/1973 | Richard et al. | 66/192 |
| 3,879,964 | 4/1975 | Pascual | 66/192 X |
| 4,425,398 | 1/1984 | Berczi | 66/193 X |
| 4,518,640 | 5/1985 | Wilkens | 66/192 X |
| 4,826,508 | 5/1989 | Schwartz et al. | 51/298 X |
| 4,867,760 | 9/1989 | Yarbrough | 51/298 |

FOREIGN PATENT DOCUMENTS

| | | |
|---|---|---|
| 0069589 | 1/1983 | European Pat. Off. . |
| 0069590 | 1/1983 | European Pat. Off. . |
| 0239126 | 9/1987 | European Pat. Off. . |
| 3235607 | 5/1983 | Fed. Rep. of Germany . |
| 2079217 | 11/1971 | France . |

OTHER PUBLICATIONS

International Search Report for PCT/EP 90/01689.

Leaflet of Gustav Ernstmeier GmbH and Company KG, 12 pages.

*Primary Examiner*—Andrew M. Falik

*Assistant Examiner*—John J. Calvert

*Attorney, Agent, or Firm*—Chilton, Alix & Van Kirk

[57] ABSTRACT

Flexible abrasive means having an underlay, which comprises a knitted fabric, which consists of a base knitted fabric (1) and at least one layer of warp threads (6) and at least one layer, separated from the latter, of weft threads (5) and includes a strengthening size. In each case a plurality of warp threads (6) per needle space (3) are held next to one another by different binding into the pattern in such a way that they run partly under and partly over the cross threads (4) of the base knitted fabric (1). All of the warp threads of a group of warp threads can be separated from one another by cross threads of this base knitted fabric alternating from the upper side to the underside of this warp thread group. A high dimensional stability of the abrasive means in the directions other than the directions of the warp and weft threads is obtained.

12 Claims, 4 Drawing Sheets

FLEXIBLE ABRASIVE MEANS

Figure 1:
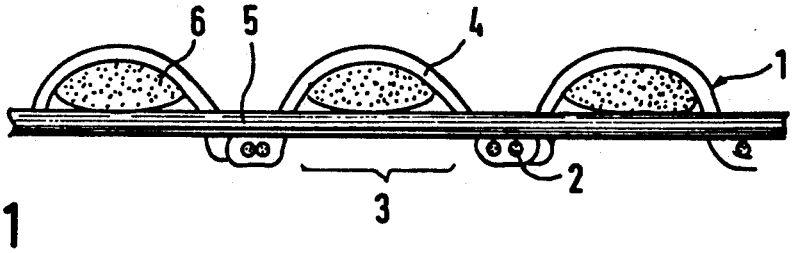

The invention relates to a flexible abrasive means having an underlay, which comprises a knitted fabric, which consists of a base knitted fabric and at least one layer of warp threads and at least one layer, separated from the latter, of weft threads and includes a strengthening size.

In the case of flexible abrasive means with textile underlay, the strength is naturally at its greatest and the elongation at its least in the direction of the weft and warp threads. In many applications, however, a high dimensional stability is also desired in directions other than the warp and weft directions. This is particularly evident in the case of so-called segmented wide bands, in which the direction of the warp and weft threads does not coincide with the running direction. If there is inadequate dimensional stability, these display a tendency to form creases. General dimensional stability is also very important in all applications which result in the abrasive means being subjected to a considerable punctiform or fulling stress.

Even in the case of woven fabrics, the reduction in dimensional stability in directions other than the directions of the threads is pronounced. It is even greater in the case of sew-knitted, i.e. stitch bonded fabrics, the structure of which is substantially looser than that of woven fabrics, said sew-knitted, or stitch bonded fabrics being used to an increasing extent recently as abrasive underlay.

The object of the invention is to provide an abrasive means of the type mentioned at the beginning which has high dimensional stability in the directions than the directions of the warp and weft threads. This provides that the abrasive structure of the invention is particularly well suited for use in a segmented abrasive belt in which the direction of the warp and weft threads of the underlay fabric from which the belt is formed differs from the longitudinal direction of the belt. This provides that the abrasive structure of the invention is particularly well suited for use in a segmented abrasive belt in which the direction of the warp and weft threads of the underlay fabric from which the belt is formed differs from the longitudinal direction of the belt.

The solution according to the invention consists in that in each case a plurality of warp threads per needle space are held next to one another by different binding into the pattern in such a way that they run partly under and partly over the cross threads of the base knitted fabric.

The desired effect can be increased by all the warp threads of one group being separated from one another by cross threads of the base knitted fabric alternating from the upper side to the underside of this warp thread group. This does not have to apply to every crossover point. However, it should be ensured by crossover points frequently following one another in the longitudinal direction in the repeat.

To explain the advantageous behaviour of the material according to the invention, the following interrelationships play a part. In an elongation of the material in the diagonal direction, a twisting or bending of the warp and weft threads with respect to one another takes place at each crossover point. The mutual binding of the threads at these points by the size can reduce these relative movements but not rule them out. In the case of the known sew-knitted fabrics (EP-B 45 408) there is only a limited number of crossover points available between weft and warp threads, namely only one crossover point per needle space in each course. This also applies even if a plurality of warp threads have been introduced into each needle space, because they are tied together by the sewing threads in the form of a skein to give a bundle of threads having a standard round thread crosssection. This tying-together is avoided by the invention. The plurality of warp threads per needle space spread out two-dimensionally. Depending on the number of warp threads per needle space, a multiplication of the crossover points in comparison with known sew-knitted fabrics is produced, and consequently a multiplication of the binding points between the warp and weft threads as well as with the knitting threads. As a result, their ability to twist with respect to one another to produce diagonal elongation is considerably restricted. Since the distances between adjacent crossover points with a given wale spacing are also reduced, the ability of the threads to bend is also reduced. Furthermore, in a diagonal elongation, an antiparallel displacement of adjacent warp and weft threads with respect to one another takes place. If—as in the case of known sew-knitted fabrics—these threads are at a great distance from one another, the size is only conditionally able to bring about a binding between them which can be subjected to loading or such a concentrated application of sizing substance is necessary for this purpose that as a result the properties of the material would be changed in an inadmissible way. Thanks to the invention, the warp threads move closer together, so that they can be bound to one another by the size and thereby secured against relative longitudinal displacement.

At the same time, the invention does not result in a greater use of warp threads, because the individual warp threads can have such a reduced cross-section in comparison with the warp threads used in conventional sew-knitted fabrics that the overall cross-sectional area of the warp threads per needle space remains unchanged.

The spreading-out of the warp threads has the further advantage that the degree of coverage of the warp threads is increased and consequently the risk of the sizing substance penetrating too deeply or even bleeding through is avoided. The question arises here whether, with adjacent warp threads in close mutual contact, it does not have to be feared that the sizing substance cannot penetrate sufficiently in order to bring about the mutual binding of adjacent warp threads. However, such a fear is unfounded, because the warp threads are separated from one another by the variety of the binding into the pattern at each crossover point or at least at short intervals by cross threads of the base knitted fabric, as a result of which capillary spacings are produced between them, into which sizing substance penetrates. It is thereby ensured that they are firmly bound not only with one another but also with the base knitted fabric by the size. In this context it is advantageous if all the warp threads of a group are separated from one another by cross threads of the base knitted fabric alternating from the upper side to the underside of this warp thread group, in order that the capillary spacings mentioned are created. It is also advantageous in this context if at least one warp thread lies over the cross thread at each crossover point of a cross thread with a group of warp threads.

It is indeed true of the invention, as it is of sew-knitted fabrics, that the position of the warp threads during the knitting operation is restricted to the needle spaces; since, however, the warp threads cross over alternately with the sewing threads, they are not combined into a single compact bundle of fibres but spread out two-dimensionally, so that not only an increased area coverage is achieved but also a surface which is smooth rathermore than of a ribbed structure. Depending on the respective embodiment of the invention, the warp threads may after their spreading-out be arranged adjacently at small distances, directly up against one another or else overlapping one another. This produces a multiplicity of the capillary-like intermediate spaces mentioned, into which the sizing substance can penetrate. After setting, this results in a substantial strengthening of the complete underlay.

Varying consistency of the sizing substance and varying adhesive properties of the set size may make a varying depth of penetration appear desirable. Similarly, different intended uses of the abrasive means and varying consistency of the set size may give rise to the wish for varying penetration through the underlay by the sizing substance. The invention can accommodate these wishes by allowing the spacing and degree of coverage of the warp threads i.e. the degree to which the warp threads within the plane of the fabric cover the plane of the fabric to be set virtually as desired. For instance, sizes which are hard—in the set state—or low-viscosity sizing substances can be processed with a small warp thread spacing without having to fear excessively deep penetration and thus an undesired embrittlement of the underlay, whereas a greater spacing or lesser degree of coverage can be chosen in the case of those sizing substances which, owing to higher viscosity or foaming, are less free-flowing and/or are adequately flexible in the set state. The abrasive means according to the invention therefore allows a hitherto unknown variability due to the type of knitted fabric forming the underlay.

It should be noted in this context that a strengthening size is to be understood as any agent which can be applied to the knitted fabric, and at least partially introduced into it, from a plastic and, in particular, free-flowing state, subsequently sets and, in the set state, brings about a strengthening of the underlay. Therefore, size in the sense of the invention may also be understood as a setting impregnation or coating which primarily serves other purposes, for example the binding of the abrasive grain to the underlay.

It is known that the knitted fabric used according to the invention can be provided with a high tensile strength and has a high surface smoothness and therefore is advantageous for example for toothed belts or printing blankets as well as generally for application purposes which demand a smooth surface (EP-A 0 069 589; EP-A 0 069 590). It is unknown, however, that this material, in combination with a size which is suitable for flexible abrasive means, results in a high dimensional stability in the directions other than the weft thread and warp thread directions.

The invention already produces an improvement in the dimensional stability and the coverage factor when used in connection with tricot knit fabrics. Even better results are achieved with a cloth knit. In this case it is possible for the wales to be covered fully or partially by warp threads, which are bound by overlapping stitching yarns which belong to other wales. This is based on the described phenomenon that the warp threads restricted to a certain needle space during the knitting operation can subsequently be displaced laterally beyond this needle space within the region predetermined by the cross threads of the knitted fabric.

According to a further feature of the invention, the warp threads can be chosen of such a type and density that in the finished sew-knitted fabric they are in a flattened-off form, the ratio of their width to their height being at least 1.8 and in practice easily of an order of magnitude of 2.3. The flattening-off does not presuppose that originally flattened-off threads are used in production. Rather, the flattening-off can also be achieved on threads originally round in cross-section, in particular if they consist of smooth, untwisted or little-twisted filament yarn and they are given sufficient space to spread out. This is to be understood dependently of the ratio of the diameter of the originally round threads to the width available to them in the product, that is to say the diameter of the warp threads multiplied by the number of warp threads per needle space in relation to the centre-to-centre distance of the wales. This ratio is expediently not greater than 80%, expediently not greater than 70%, more expediently not greater than 60%, more expediently not greater than 50%. For example, a value of at least 80% is achieved for instance with a fineness of the knitted fabric of 20 needles per inch and an insertion of four warp threads each (fineness 550 dtex, multifilament yarn, polyester) per needle space. The diameter of the originally round warp threads can be determined by equal-area conversion of the cross-section found in the finished product into the circular cross-section. Instead of this, it can also be determined from the principles stated at the top of page 6 in EP-B 0 073 313. The width of the warp threads is to be understood as their dimension transversely to their longitudinal extent in the plane of the underlay. Their height is their cross-sectional dimension running transversely thereto. If the warp threads are arranged correspondingly closely, due to the flattening-off of the threads there is in the finished product an extensive mutual overlapping. If this is not desired, it is possible to use a smaller number, for example instead of four warp threads (fineness 550 dtex) only two warp threads (fineness 1100 dtex) per needle space. The fineness of the fabric can also be reduced. In principle, an underlay meeting the specific requirements of the respective abrasive process can be obtained by corresponding selection of the yarns, the fineness of the fabric, the number of warp threads, the binding and other parameters familiar to a person skilled in the art. A particularly advantageous possibility has proven to be that of varying the degree of area coverage, and consequently also the spacing of the individual warp threads with respect to one another, by using the design features according to the invention in such a way that the quantity of sizing substance consequently absorbed results in the desired flexibility or rigidity of the abrasive means. A significant advantage of the invention over conventional sew-knitted fabrics consists in that a multiplication of the number of warp threads results in an increase in the degree of coverage without increasing the quantity of warp thread material. For example, with a quadrupling of the number of warp threads, a doubling of the degree of coverage is achieved.

The degree of coverage of the warp threads is preferably greater than 60%, more preferably greater than 70%, more preferably greater than 80%. As already mentioned, it can reach 100%, if the warp threads are directly up against one another or even overlap one another.

In the case of known abrasive means, the underlay of which includes a sew-knitted fabric, the warp thread side is unsuitable for receiving the layer of abrasive grain. The warp thread arrangement achieved in the abrasive means according to the invention also allows such a good anchorage of the size or of the binding agent, however, that the abrasive grain can, if desired, be arranged on the warp side. Apart from a quality of the abrasion finish hitherto unachieved with sew-knitted fabrics and the possibility of using a fabric underlay for fine abrasive grain as well, the arrangement of the abrasive grain on the warp side has, furthermore, the advantage that the abrading forces are transferred from the grain directly onto that layer of the underlay which transfers the longitudinal forces, without a layer of weft threads being arranged in between.

Figure 2:
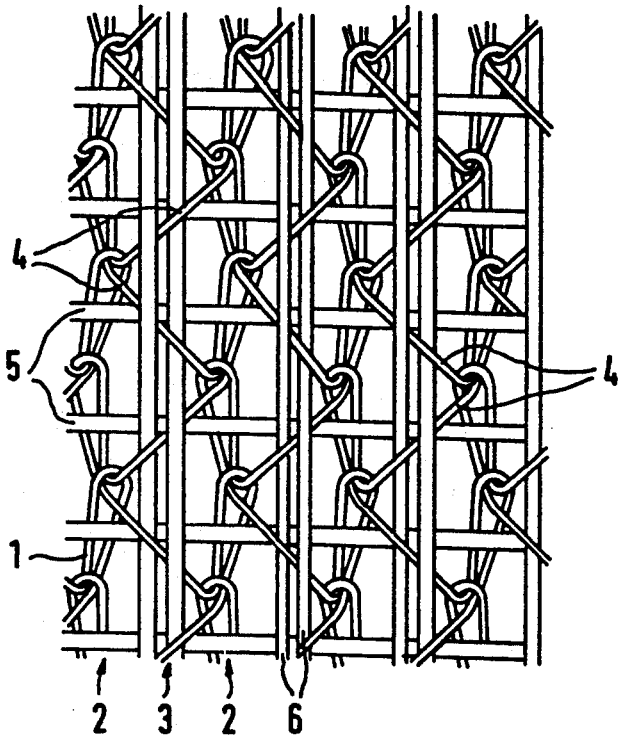
Figure 3:
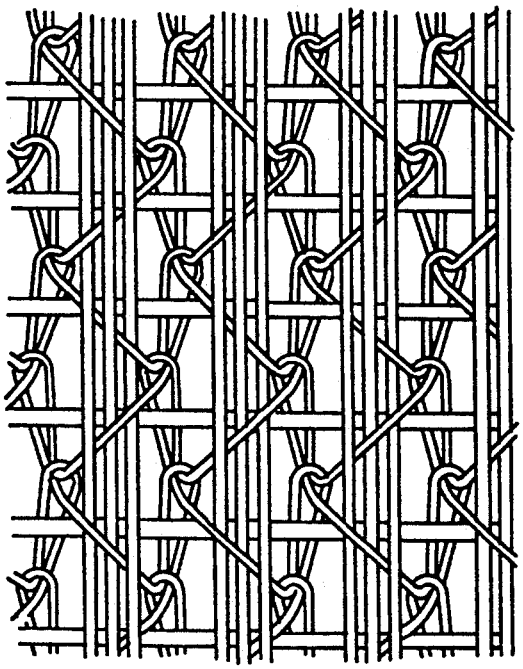
Figure 4:
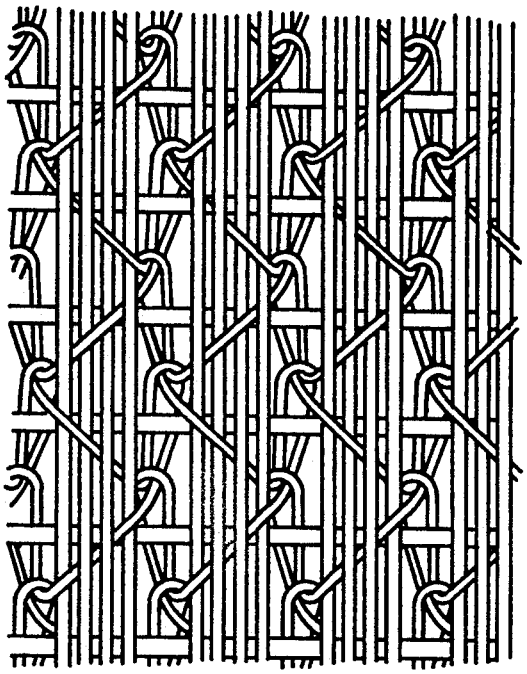
Figure 5:
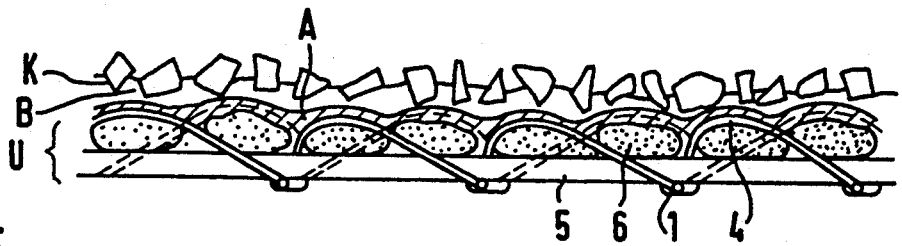
Figure 6:
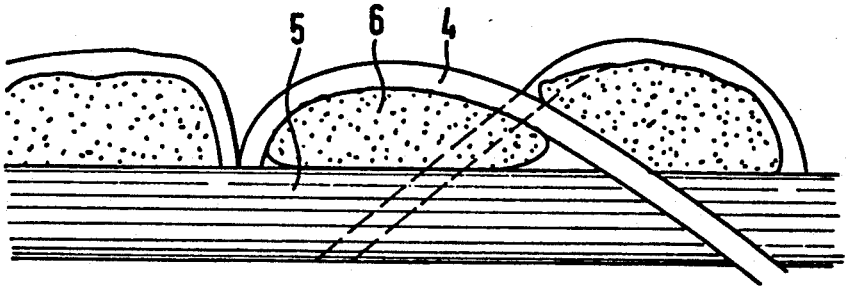
Figure 7:
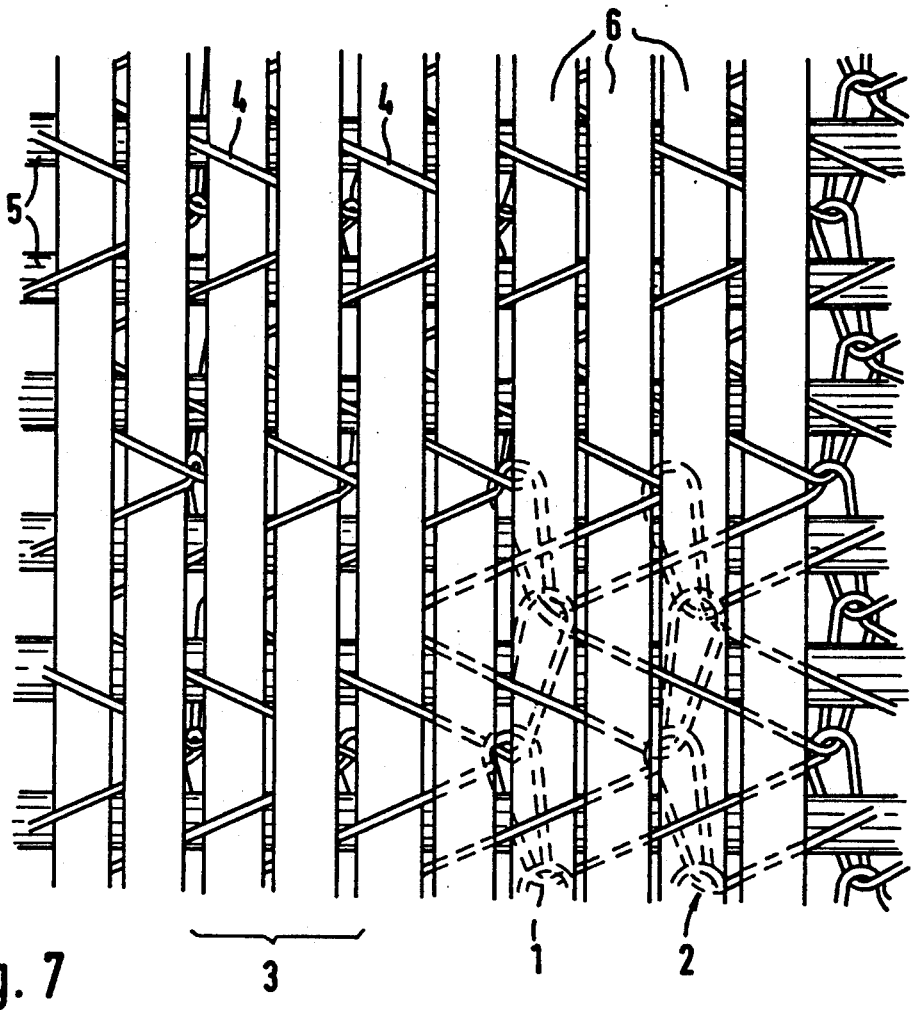
Figure 8:
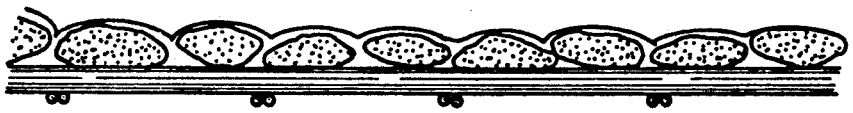
Figure 9:
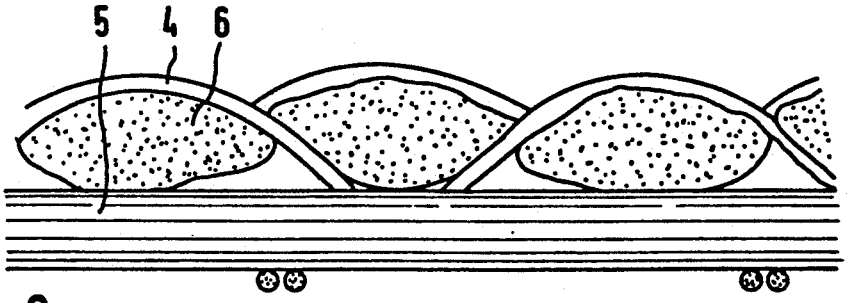

The invention is explained in further detail below with reference to the drawing, in which:

FIG. 1 shows a cross-section through a conventional sew-knitted fabric,

FIGS. 2 to 4 show plan views of knitted fabrics according to the invention with tricot weave (warp thread side), FIGS. 5 and 6 show cross-sections on different scales through a knitted fabric in tricot weave according to the invention, FIG. 7 shows the plan view of a knitted fabric according to the invention in cloth weave (warp thread side) and FIGS. 8 and 9 show cross-sections on different scales through such a knitted fabric.

Figure 10:
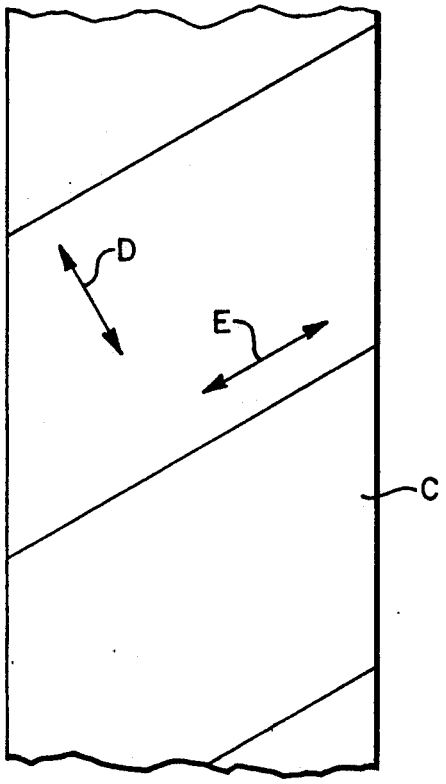

FIG. 10 shows a segmented abrasive belt incorporating the abrasive structure of the present invention.

A flexible abrasive means of the type with which the invention is concerned is made up (see FIG. 5) of an underlay U and a layer of grain K, which are bound to each other by a binding agent B. The underlay includes a sheet-like textile material absorbing the forces, which material is strengthened by a size A, which is intended to penetrate into the textile material usually only to a limited depth to avoid embrittlement. Size may be provided on both sides of the textile material or only one one side. Apart from strengthening, it may also have other purposes, for example preventing the binding agent bleeding through the underlay and/or bringing about an adhesive coupling with the binding agent and/or producing on the rear of an abrasive belt a high friction coefficient with respect to the drive rollers. For the sake of simplicity, only the textile material is shown in the other figures.

Apart from the textile material, the underlay may include other layers, but other layers are preferably dispensed with.

The sew-knitted fabric of a conventional type illustrated in FIG. 1 comprises sewing threads 1, which form wales 2, which are joined by cross threads 4 in the needle spaces 3. The sewing threads 1 join weft threads 5 and warp threads 6. There is only one warp thread in each needle space. The warp threads are bundled by the sewing threads and kept at a distance. This is also not altered in any way if thicker warp threads or a plurality of warp threads per needle space are used. The drawing, which is an enlarged representation of a photograph of a knitted fabric used in practice, reproduces the actual situation clearly and shows in particular that the degree of coverage is small and the mutual spacing of the warp threads is great.

FIGS. 2 to 4 show pattern lay-outs of knitted fabrics in tricot weave according to the invention. The knitting threads 1 form wales 2, which are joined in the needle spaces 3 by cross threads 4. In all of the exemplary embodiments, there is one weft thread 5 laid in each course. It is also possible for a plurality of weft threads to be laid, or a thread lay can be additionally applied by sew-knitting or in another way. Warp threads 6, the number of which differs in the figures, are boundin in each needle space 3. They thereby form part of the knitted fabric by being bound into the pattern. This means that they run partly under and partly over the cross threads 4. In this case the arrangement is chosen such that at least one warp thread runs over and at least one runs under each cross thread at each crossing point.

FIGS. 5 and 6 illustrate the cross-sectional shape which is obtained in practice if the pattern lay-out according to FIG. 2 is used and the data of Example 1 is taken as a basis. Since the knitting threads 1 extend over a greater width than corresponds to the width component of a warp thread, the warp threads are not closely bundled and their space in the transverse direction is also not as rigidly defined as in the case of conventional sew-knitted fabrics. They can therefore spread out in cross-section and move up against one another, so that a high degree of coverage of the warp threads is achieved. As FIG. 6 shows, this may even result in a mutual overlapping of adjacent warp threads. This is made possible by the cross threads, which alternately bind the one and then the other weft thread, not occurring at the same crossover point but at a longitudinal distance from one another. At that point at which the sections according to FIGS. 5 and 6 are taken, there lies the knitting thread binding the warp thread appearing on the left in each needle space. As a result, an overlapping of the right warp thread over the left warp thread is encouraged. On the other hand, at those points at which there lies the knitting thread binding what is respectively the right warp thread, the left warp thread tends to overlap the right warp thread.

The representation illustrates furthermore that a good degree of coverage is achieved, it being ensured by the cross threads that the adjacent warp threads do not unite to give a uniform bundle but a certain spacing remains between them, at least in the vicinity of the cross threads 4, which spacing is greater or smaller depending on the thickness of the warp threads, but at least has a capillary width corresponding to the thickness of the cross threads, so that sizing substance of suitable consistency can penetrate and bind the adjacent warp threads and the cross threads to one another.

With the same use of warp threads (sum of warp thread cross-sections per needle space), in this way a substantially higher degree of coverage is achieved than in the case of conventional sew-knitted fabrics (FIG. 1). Moreover, even with the same degree of coverage of the warp threads, the binding conditions are much better, because the number of crossover points is doubled and the distance between adjacent warp threads is halved.

This is how the knitted fabric according to the invention presents a much greater resistance than a conventional sew-knitted fabric to all those deformations which are associated with stressing in a direction other than that of the direction of the threads.

Furthermore, it is noticeable in a comparison of FIGS. 5 and 1 that a much greater surface smoothness is achieved on the warp thread side by the invention than in the case of conventional sew-knitted fabrics. This is also due to the fact that at least one warp thread runs over and at least one runs under each cross thread at each crossover point. Next to each cross thread there lies a warp thread which is at least just as high. Unlike in the case of conventional sew-knitted fabrics, the cross threads therefore do not occur as the highest points and are therefore less exposed to externally originating mechanical stress.

In spite of their close arrangement, the warp threads are thus always kept distinctly separate from one another and parallel to one another by the cross threads. As a result, on the one hand their maximum spread in the plane of the knitted fabric and on the other hand the guarantee of an adequate possibility of anchorage between them are ensured. In the case of other patterns, in particular with a greater number of warp threads per needle space, it is always to be guaranteed that the cross threads run partly above and partly underneath the adjacent cross threads, in order that the closed structure which prevents bleeding-through of the base binding agent is achieved, and adequate anchorage of the sizing substance is permitted.

The knitted fabric lends the longitudinally oriented rib structure typical of sew-knitted fabrics, and has a rathermore smooth, even surface; the sewing thread in a knitted fabric of this construction is subjected to virtually no significant wear any longer. In addition, a knitted fabric having such a smooth surface finish can also be used for fine abrasive grain and offers considerable application advantages in the areas of use in which sew-knitted fabrics have been used until now, in particular an improved abrasion finish and less wear of supporting elements.

Regarding the thread material used, preferably filament yarn is used. However, staple fibre yarn or other synthetic or natural yarn material may also be used.

FIG. 7 illustrates the pattern lay-out of a knitted fabric with cloth knit according to the invention. This is distinguished by the fact that the cross threads 4 run between not directly adjacent wales 2. As a result, the bundling effect of the cross threads on the warp threads 6 is further reduced, so that the warp threads can spread out sideways virtually freely once the knitted fabric has been produced. As a result, a high degree of coverage is achieved using less warp yarn. Even the wales themselves are covered, namely by warp threads which are held by cross threads which belong to the wales respectively adjacent to the covered wales. The pattern lay-out according to FIG. 7 results in practice in a cross-sectional lay-out as illustrated in FIGS. 9 and 10. As can be clearly seen, if the data of Example 3 are taken as a basis, the degree of coverage is virtually 100%, there being a clear separation of the adjacent warp threads from one another in spite of a high surface smoothness and with the maintenance of intermediate spaces for the anchorage of size being ensured.

FIG. 10 shows a segmented abrasive belt which is made from segments C of the abrasive structure of the invention, which are joined together. The directions of the warp and weft threads, shown by arrows D and E, respectively, are diagonal relative to the longitudinal direction of the belt.

EXAMPLE 1

| | |
|---|---|
| Machine: | Raschel knitting machine of Messrs. Mayer, Obertshausen, mod. RS4 MSU-N, equipped with at least 3–6 guide bars and the associated devices for the knitting of warp thread patterns as well as a weft insertion device. |
| Yarns: | Warp thread: Multifilament yarn, dtex 1100 f 210 polyester, high tenacity<br>Sewing thread: Multifilament yarn, dtex 150 f 48 polyester<br>Weft thread: Multifilament yarn, dtex 1100 f 210 polyester, high tenacity<br>The yarns are commercially available and can be obtained for example from Messrs. Hoechst AG, Frankfurt. |

Pattern notation and draw-in:

| Pattern notation: | L 1<br>sewing thread | L 2<br>first warp thread | L 33<br>second warp thread |
|---|---|---|---|
| | 0 | 0 | 0 |
| | 2 | 0 | 0 |
| | 4 | 2 | 0 |
| | 2 | 2 | 0 |
| | | 0 | 0 |
| | | 0 | 0 |
| | | 0 | 2 |
| | | 0 | 2 |
| Draw-in: | full<br>dtex 150 | full<br>dtex 1100 | full<br>dtex 1100 |

The knitted fabric thus obtained corresponds to FIGS. 2, 5 and 6 and has a tear strength of about 3900 N/5 cm in the warp direction and in the weft direction.

EXAMPLE 2

| | |
|---|---|
| Machine: | corresponding to Example 1 |
| Yarns: | corresponding to Example 1 |

Pattern notation and draw-in:

| Pattern notation: | L 1<br>sewing thread | L 2<br>first warp thread | L 3<br>second warp thread | L 4<br>third warp thread |
|---|---|---|---|---|
| | 0 | 0 | 0 | 2 |
| | 2 | 0 | 0 | 2 |
| | 4 | 2 | 2 | 2 |
| | 2 | 2 | 2 | 2 |
| | | 2 | 0 | 0 |
| | | 2 | 0 | 0 |
| | | 2 | 0 | 2 |
| | | 2 | 0 | 2 |
| Draw-in: | full<br>dtex 150<br>f 48 | full<br>dtex 1100 f 210, polyester, high tenacity | full | full |

The knitted fabric obtained corresponds to FIG. 3.

The further processing of the knitted fabric according to the invention into an abrasive means on an underlay is performed by a conventional technique.

EXAMPLE 3

| | |
|---|---|
| Machine: | corresponding to Example 1 |
| Yarns: | corresponding to Example 1 |

Pattern notation and draw-in:

| Pattern notation: | L 1<br>sewing thread | L 2<br>first warp thread | L 3<br>second warp thread |
|---|---|---|---|
| | 2 | 2 | 0 |
| | 0 | 2 | 0 |

-continued

| | | | |
|---|---|---|---|
| Machine: | corresponding to Example 1 | | |
| Yarns: | corresponding to Example 1 | | |
| | Pattern notation and draw-in: | | |
| | 4 | 4 | 4 |
| | 6 | 4 | 4 |
| | | 0 | 2 |
| | | 0 | 2 |
| | | 4 | 4 |
| | | 4 | 4 |
| Draw-in: | full | full | full |
| | dtex 150 f 48 | full dtex 1100 f 210, polyester, high tenacity | |

The knitted fabric obtained corresponds to FIGS. 7, 8 and 9.

The further processing of the knitted fabric according to the invention into an abrasive means on an underlay is performed by a conventional technique.

I claim:

1. Flexible abrasive structure having a underlay and layer of abrasive grain arranged on the underlay, the underlay comprising a base knitted fabric and a sizing for strengthening the fabric, the fabric including at least one layer of warp threads arranged to define a plurality of needle spaces, at least one separate layer of weft threads, and cross threads which cross the needle spaces at a plurality of crossover points, wherein a plurality of warp threads per needle space are held next to one another in a pattern in such a way that the warp threads run partly under and partly over the cross threads of the base knitted fabric at each crossover point, the fabric crossover points defining a space for allowing the sizing to penetrate the fabric and to increase the strength of the complete underlay.

2. Abrasive structure according to claim 1, wherein the plurality of warp threads per needle space form a warp thread group with an upper side and an underside, and the warp threads in the warp thread group are separated from one another by cross threads of the base knitted fabric alternating from the upper side to the underside of the warp thread group.

3. Abrasive structure according to claim 1, wherein at least one warp thread lies over the cross thread at each crossover point of a cross thread with a group of warp threads.

4. Abrasive structure according to claim 1, wherein the base knitted fabric is a tricot knit fabric.

5. Abrasive structure according to claim 1, wherein the base knitted fabric is a cloth knit fabric.

6. Abrasive structure according to claim 5, wherein the base knitted fabric includes wales which are at least partially covered by warp threads.

7. Abrasive structure according to claim 1, wherein the warp threads have a width and a thickness, the ratio of the width to the thickness being at least about 1.3.

8. Abrasive structure according to claim 6, wherein the underlay has a plurality of wales, each warp thread has an original diameter, and the original diameter of the warp threads multiplied by the number of warp threads per needle space is not greater than 80% of the centre-to-centre distance of the wales.

9. Abrasive structure according to claim 8, wherein the original diameter of the warp threads multiplied by the number of warp threads per needle space is not greater than 60% of the centre-to-centre distance of the wales.

10. Abrasive structure according to claim 1, wherein the underlay has a warp side and a weft side, and the layer of abrasive grain is arranged on the warp side.

11. Abrasive structure according to claim 1 particularly well suited for use in a segmented abrasive belt having a length, wherein the direction of the warp and weft threads of the fabric differs from the direction of the length of the belt.

12. An abrasive structure according to claim 1, wherein the base knitted fabric is planar, and the warp threads within the plane of the fabric cover at least 60% of said plane.

* * * * *